US009157708B1

(12) United States Patent
Kostka et al.

(10) Patent No.: US 9,157,708 B1
(45) Date of Patent: Oct. 13, 2015

(54) ELECTRIC AND MAGNETIC FIELD HARDENED IGNITER FOR ELECTRICALLY FIRED AMMUNITION

(71) Applicants: John F. Kostka, Denville, NJ (US); Jason D. Mishock, Sussex, NJ (US)

(72) Inventors: John F. Kostka, Denville, NJ (US); Jason D. Mishock, Sussex, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 237 days.

(21) Appl. No.: 13/888,589

(22) Filed: May 7, 2013

(51) Int. Cl.
*F42B 3/103* (2006.01)
*F42B 5/08* (2006.01)
*F42B 3/11* (2006.01)

(52) U.S. Cl.
CPC . *F42B 5/08* (2013.01); *F42B 3/103* (2013.01); *F42B 3/11* (2013.01)

(58) Field of Classification Search
CPC ..... F42B 3/11; F42B 3/124; F42B 3/128; F42B 3/14; F42B 3/103; F42B 3/12
USPC ..... 102/202.5, 202.7, 202.8, 202.9, 202.14
See application file for complete search history.

(56) References Cited

U.S. PATENT DOCUMENTS

| | | | | |
|---|---|---|---|---|
| 372,046 | A * | 10/1887 | Stuart | 102/202.9 |
| 5,932,832 | A * | 8/1999 | Hansen et al. | 102/202.4 |
| 6,305,286 | B1 * | 10/2001 | Fogle et al. | 102/202.5 |
| 2002/0174791 | A1 * | 11/2002 | Avetisian et al. | 102/202.7 |

FOREIGN PATENT DOCUMENTS

EP 1 457 758 A1 * 9/2004

* cited by examiner

*Primary Examiner* — Stephen M Johnson
(74) *Attorney, Agent, or Firm* — Henry S. Goldfine

(57) ABSTRACT

An EMF hardened igniter for electrically fired ammunition includes a central electrode, a dielectric that surrounds the central electrode, and a conductive body that surrounds the dielectric. A hot wire is fixed to an output end of the central electrode and to the conductive body. An ignition mixture is in contact with the hot wire. A cup surrounds and contains the ignition mixture. The cup is sealed to the conductive body. An outer surface of the central electrode is mechanically locked with an inner surface of the dielectric. An outer surface of the dielectric is mechanically locked with an inner surface of the conductive body.

18 Claims, 3 Drawing Sheets

ELECTRIC AND MAGNETIC FIELD HARDENED IGNITER FOR ELECTRICALLY FIRED AMMUNITION

STATEMENT OF GOVERNMENT INTEREST

The inventions described herein may be manufactured, used and licensed by or for the United States Government.

BACKGROUND OF THE INVENTION

The invention relates in general to electrically fired ammunition and in particular to igniters for electrically fired ammunition.

Electrically fired ammunition may use an electrical current to ignite a primer, and the primer may then ignite the main propellant charge in the round of ammunition. Electrically tired ammunition may be stored and transported in packaging containers that help prevent the ammunition from undesirably initiating in the presence of electromagnetic fields (EMFs). When the ammunition is outside of the packaging containers, there are restrictions on handling the ammunition in the presence of certain EMFs. Tests have shown that some radio-generated EMFs may initiate the ammunition, causing adverse consequences. This problem has existed for many years, but recent research has more precisely recognized the cause of the problem.

The increase in radio technology used in military operations generates a higher risk of unintended initiation during routine loading and handling of electrically fired ammunition. In the past, the ammunition was either packaged in metal cans or sealed in ammunition storage compartments to protect the ammunition from EMF initiation. Unfortunately, neither of these options lessens the risk during loading and handling operations when the ammunition is not in the cans or storage compartments. One available technology to address the problem is grounding tabs. However, the grounding tabs must be removed before the ammunition can be fired. Grounding tabs can be inadequate and unacceptable because of the potential of a misfire caused by failure to remove the grounding tabs. Many concepts have been tested, but none appear to be able to withstand the extreme pressure of the ballistic cycle of a cannon/gun system, while also providing EMF protection. The ballistic pressure may be on the order of 100,000 psi.

A need exists for an igniter for electrically fired ammunition that is hardened against EMF and able to survive the ballistic cycle in a gun/cannon environment. The EMF hardened igniter should not degrade the performance of the ammunition nor require changes in ammunition handling and operational procedures.

SUMMARY OF INVENTION

One aspect of the invention is a novel igniter for electrically fired ammunition. The igniter includes a central electrode, a dielectric, a conductive body, at least one hot wire, an ignition mixture, and a cup. The central electrode has an input end, an output end, and an outer surface. The dielectric surrounds the central electrode and has an outer surface and an inner surface. The dielectric inner surface is contiguous to the outer surface of the central electrode. The outer surface of the central electrode and the inner surface of the dielectric are fixed to each other by at least one mechanical lock. The conductive body surrounds the dielectric and has an inner surface that is contiguous to the outer surface of the dielectric.

The inner surface of the conductive body and the outer surface of the dielectric are fixed to each other by at least one mechanical lock.

The at least one hot wire is fixed at one end to the output end of the central electrode and at another end to the conductive body. The ignition mixture in contact with a majority of surface area of the at least one hot wire. The cup surrounds and contains the ignition mixture. The cup has an inner surface that is contiguous to the ignition mix. The cup is fixed to the conductive body.

The central electrode may have a generally cylindrical shape. The dielectric may have a generally hollow cylindrical shape. The conductive body may have a generally hollow cylindrical shape.

The at least one hot wire may be parallel to a plane that contains the output end of the central electrode.

The dielectric may include an output end and the conductive body may include an output end. The hot wire may be in contact with the output end of the central electrode, the output end of the dielectric and the output end of the conductive body.

The cup may include a bottom and a side. The bottom may be parallel to the plane that contains the output end of the central electrode. The cup may be fixed to the conductive body by welding the side of the cup to the conductive body.

The hot wire may be welded to the output end of the central electrode and the output end of the conductive body.

The at least one mechanical lock that fixes the outer surface of the central electrode and the inner surface of the dielectric may include protrusions on the inner surface of the dielectric and corresponding mating circumferential channels in the outer surface of the central electrode.

The at least one mechanical lock that fixes the outer surface of the dielectric and the inner surface of the conductive body may include a stepped down portion on the inner surface of the conductive body and a corresponding mating stepped up portion on the outer surface of the dielectric.

Another aspect of the invention is a novel primer head assembly. The primer head assembly includes a primer housing and an igniter disposed in the primer housing.

In another aspect of the invention, a novel electric primer includes a primer head assembly and a primer body assembly fixed to the primer head assembly.

In a further aspect of the invention, a novel electrically fired munition includes a case with a base, an electric primer disposed in the base, and propellant disposed in the case.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel EMF hardened igniter may be used with a range of electrically fired ammunition calibers, for example, from about 20-40 mm to about 105-155 mm. "EMF hardened" means the igniter can withstand a higher EMF environment without igniting the ignition mix in the igniter.

One important feature of the igniter is a heat sink that transfers heat induced by EMFs away from the hot wire in the igniter. Other important features of the igniter are the mechanical connections between the components of the igniter. The mechanical connections remain intact under very high pressure, for example, 100,000 psi. The self-contained, hermetic seal of the igniter is an important feature, also. The interior of the igniter is sealed independently of the munition in which the igniter may be used.

Figure 1:
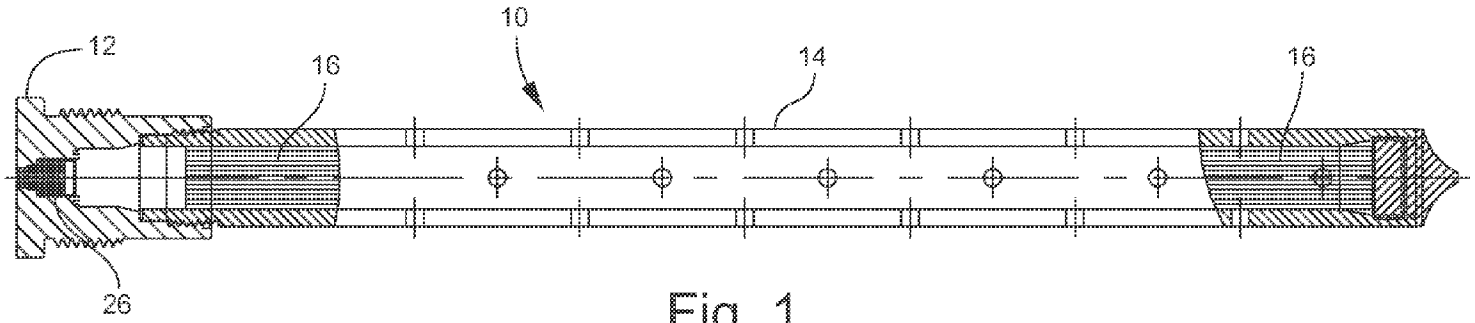
FIG. 1 is a side view, partially in section, of one embodiment of an EMF hardened electric primer.
Figure 4:
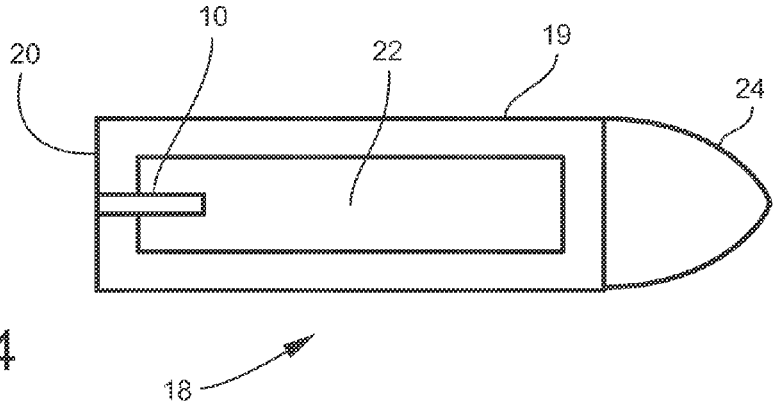
FIG. 4 is a schematic side view of an example of an electrically fired munition.

FIG. 1 is a side view, partially in section, of one embodiment of an EMF hardened electric primer 10. Primer 10 may include a primer head assembly 12 and a primer body assembly 14. Body assembly 14 may be threaded into head assembly 12. Body assembly 14 may include propellant 16. Primer head assembly 12 includes an EMF hardened igniter 26. Primer 10 may be installed in the base 20 (FIG. 4) of an electrically fired munition 18. Igniter 26 ignites propellant 16 in primer 10, thereby igniting propellant 22 contained in case 19 of munition 18 and propelling projectile 24. Primer 10 is but one example of an electric primer in which igniter 26 may be used.

Figure 2:
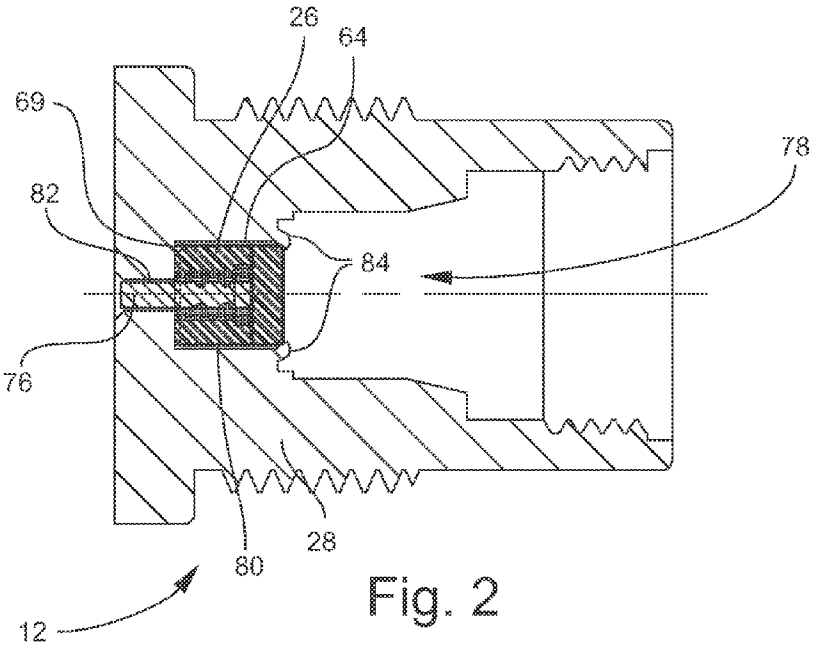
FIG. 2 is an enlarged sectional view of the primer head assembly shown in the primer of FIG. 1.

FIG. 2 is an enlarged sectional view of primer head assembly 12. Assembly 12 includes a housing 28 with igniter 26 disposed therein. Primer head assembly 12 is but one example of a primer head assembly in which igniter 26 may be used.

Figure 3:
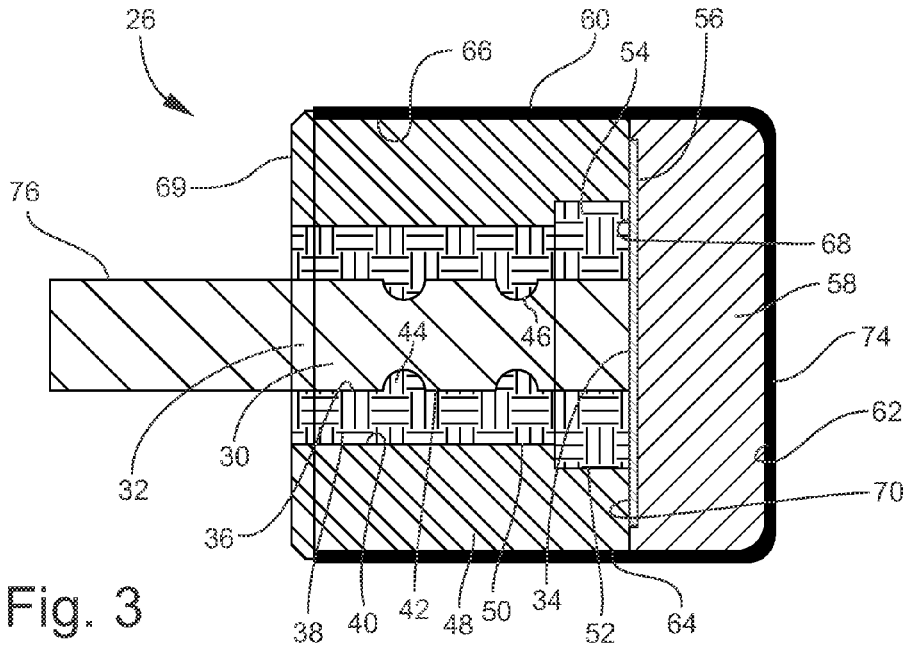
FIG. 3 is an enlarged sectional view of the igniter shown in the primer head assembly of FIG. 2.

FIG. 3 is an enlarged sectional view of igniter 26. Igniter 26 includes a central electrode 30 having an input end 32, an output end 34, and an outer surface 36. Central electrode 30 may be generally cylindrical. A dielectric 38 surrounds central electrode 30. Dielectric 38 has an outer surface 40 and an inner surface 42. Inner surface 42 is contiguous to outer surface 36 of central electrode 30. Dielectric 38 may have the general shape of a hollow cylinder. Dielectric 38 may be made of, for example, glass, ceramic, or polymer. Dielectric 38 may be formed by, for example, molding, sintering, machining, extruding, etc.

Axial translation of central electrode 30 with respect to dielectric 38 is prevented by a mechanical lock(s) formed on one or both of outer surface 36 of central electrode 30 and inner surface 42 of dielectric 38. The mechanical locks also provide a high pressure gas seal between central electrode 30 and dielectric 38. In the embodiment shown, the mechanical locks are protrusions 44 formed on dielectric 38 and corresponding mating circumferential channels 46 formed in central electrode 30. Protrusions 44 and channels 46 are an example of a suitable mechanical lock. Other types of mechanical locks may be used to prevent axial translation of central electrode 30 with respect to dielectric 38. Some other examples of mechanical locks for outer surface 36 and inner surface 42 include notches of various shapes, stepped features, scoring, knurling, etc.

An electrically conductive body 48 surrounds dielectric 38. Conductive body 48 may have the general shape of a hollow cylinder. Conductive body 48 has an inner surface 50 that is contiguous to outer surface 40 of dielectric 38. Axial translation of conductive body 48 with respect to dielectric 38 is prevented by a mechanical lock(s) formed on one or both of outer surface 40 of dielectric 38 and inner surface 50 of conductive body 48. The mechanical locks also provide a high pressure gas seal between conductive body 48 and dielectric 38.

In the embodiment shown, the mechanical lock is a stepped down (less radial thickness) portion 52 on conductive body 48 and a corresponding mating stepped up (more radial thickness) portion 54 on dielectric 38. During operation of igniter 26, high pressure gas acts on igniter 26 with the force vector of the high pressure gas pointing to the left, in the orientation of igniter 26 shown in the Figures. Thus, stepped up portion 54 is pressed into body 48. Stepped down portion 52 and stepped up portion 54 is an example of a suitable mechanical lock. Other types of mechanical locks may be used to prevent axial translation of conductive body 48 with respect to dielectric 38. Some other examples of mechanical locks for outer surface 40 of dielectric 38 and inner surface 50 of conductive body 48 include notches of various shapes, stepped features, scoring, knurling, etc.

At least one hot wire 56 is fixed at one end to output end 34 of central electrode 30 and at another end to conductive body 48. An ignition mixture 58 is disposed such that it is in contact with a majority of the surface area of hot wire 56. Ignition mixture 58 must maintain intimate contact with hot wire 56. A cup 60 surrounds and contains ignition mixture 58. Cup 60 has an inner surface 62 that is contiguous to ignition mix 58. Cup 60 is fixed to conductive body 48 by, for example, welding the side 64 of cup 60 to an outer surface 66 of conductive body 48. Ignition mixture 58 may be, for example, pressed into cup 60.

Some ignition mixtures used in the past include, for example, lead thiocyanate or zirconium potassium chlorate (ZPC), having an auto-ignition temperature in a range of about 190 degrees C. to about 210 degrees C. An ignition mixture 58 with a higher auto-ignition temperature can be helpful in hardening igniter 26 against EMF. In one embodiment, ignition mixture 58 may be zirconium potassium perchlorate (ZPP). ZPP may have an auto-ignition temperature of around 350 degrees C. Another advantage of using ZPP is the elimination of environmentally hazardous lead from the ignition mixture.

In operation, hot wire 56 is desirably heated when a firing pulse is delivered from the firing pin of a cannon or gun through central electrode 30. But, when a firing pulse is not delivered from a firing pin, hot wire 56 may nevertheless be undesirably heated by local EMFs. Conductive body 48, dielectric 38, and central electrode 30 function as a heat sink to transfer heat away from hot wire 56. Preferably, hot wire 56 is a linear wire that is parallel to a plane that contains output end 34 of central electrode 30. Dielectric 38 includes an output end 68 and conductive body 48 includes an output end 70. Hot wire 56 is preferably in contact with output end 34 of central electrode 30, output end 68 of dielectric 38 and output end 70 of conductive body 48.

Figure 5:
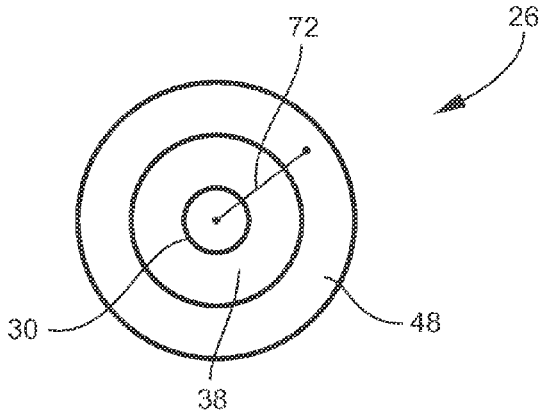
FIG. 5 is a schematic top view of an igniter with cup and ignition mix removed, showing one alternative arrangement of a hot wire.

Hot wire 56 may take several forms. As shown in FIG. 3, hot wire 56 may be a single wire that is welded to at least both central electrode 30 and at each end to conductive body 48. FIG. 5 is a schematic top view of igniter 26 with cup 60 and ignition mixture 58 removed, showing one alternative arrangement of a hot wire 72. Hot wire 72 has one end welded to central electrode 30 and another end welded to conductive body 48. Additional hot wires 72 may be added, similar to the appearance of spokes on a wheel. In general, the greater the combined length of all the hot wire(s) in igniter 26, the less sensitive is igniter 26 to EMF.

Preferably, an exterior surface of the bottom 74 of cup 60 includes a cruciform (not shown) formed thereon for uniform rupture and ignition.

In the embodiment of igniter 26 shown in the Figures, central electrode 30 optionally includes an extended portion 76 that extends beyond dielectric 38 and conductive body 48. Extended portion 76 is useful when installing igniter 26 in primer housing 28 of FIG. 2. While shown as being generally cylindrical, extended portion 76 may also include, for example, a head or widened area formed on its free end to facilitate a larger contact area.

Referring to FIG. 2, primer housing 28 includes a through-bore 78 having one portion 80 sized for a close tolerance fit with cup 60 and a second portion 82 sized for a clearance fit with extended portion 76 of central electrode 30. A dielectric or insulating material, for example, plastic, glass, or ceramic, may be inserted between extended portion 76 and second portion 82. Side 64 of cup 60 forms a metal to metal seal with portion 80, especially when high pressure gas from the main propellant impinges on respective output ends 34, 68, and 70 (FIG. 3) of central electrode 30, dielectric 38, and conductive body 48. In addition, an aft end 69 of conductive body 48 (see also FIG. 2) forms a metal to metal seal with housing 28 where through bore 78 transitions or steps down in diameter from portion 80 to portion 82. Primer housing 28 may include a crimping ring 84 to further seal igniter 26 in primer housing 28. Other means to secure igniter 26 in primer housing 28 include, for example, retaining sleeves or rings (with or without a shoulder in primer housing 28), welding, press fit, adhesives, etc.

Figure 6:
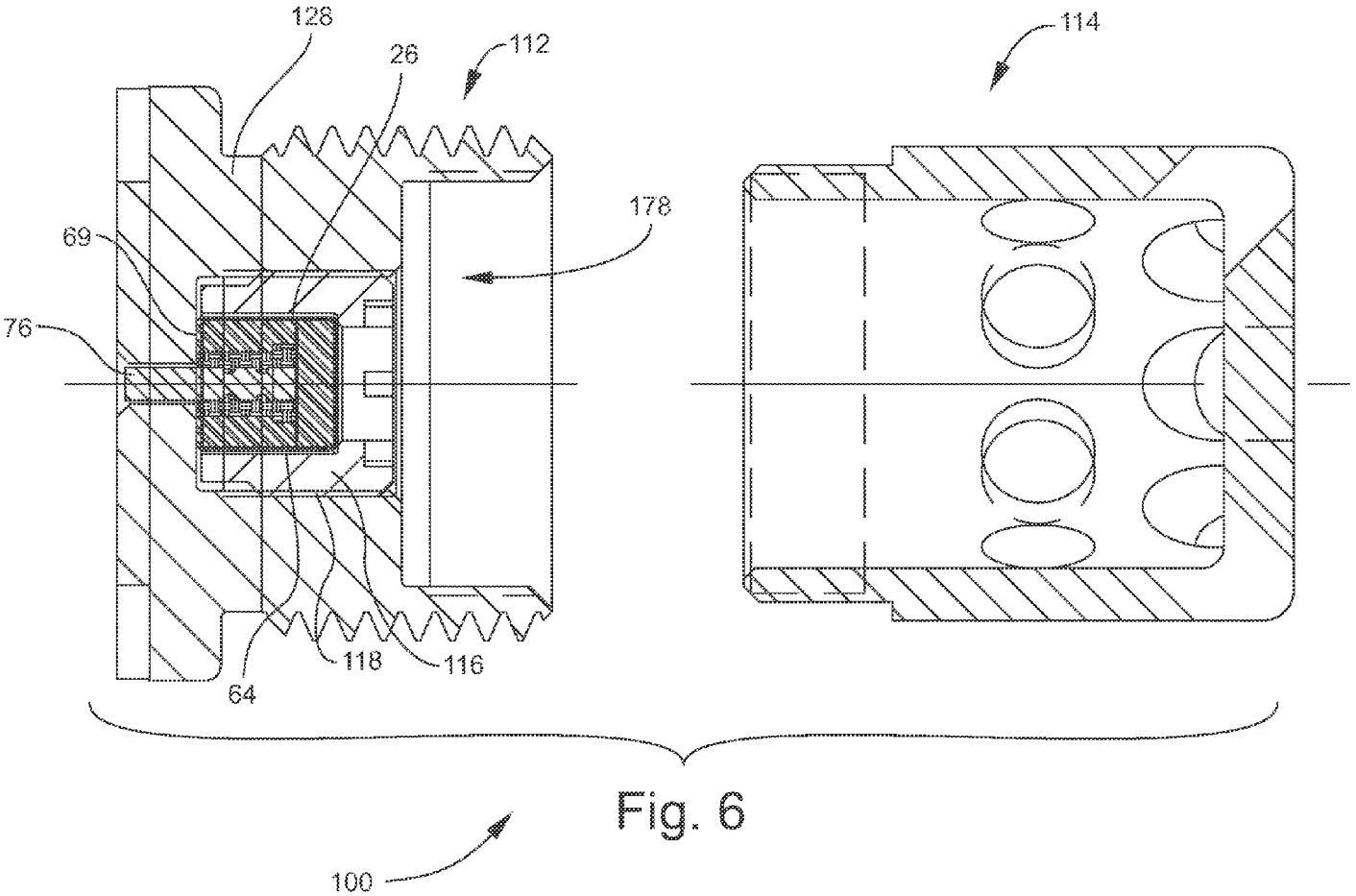
FIG. 6 is a side sectional view of another embodiment of an EMF hardened electric primer.

FIG. 6 is a side sectional view of another embodiment of an EMF hardened electric primer 100 having a primer head assembly 112 and a primer body assembly 114. Primer body assembly 114 may be threaded into primer head assembly 112. Primer head assembly includes a housing 128, a sleeve 116, and igniter 26. External threads on sleeve 116 may form a sealed threaded joint 118 with internal threads in the through bore 178 of housing 128.

Igniter 26 may be press fit in sleeve 116 such that side 64 of cup 60 forms a metal to metal seal with the interior of sleeve 116, especially when high pressure gas from the main propellant impinges on respective output ends 34, 68, and 70 (FIG. 3) of central electrode 30, dielectric 38, and conductive body 48. In addition, an aft end 69 of conductive body 48 (see also FIG. 2) forms a metal to metal seal with housing 128 where through bore 178 transitions or steps down in diameter from the portion of housing 128 that contains sleeve 116 to the portion of housing 128 that contains extended portion 76 of central electrode 30.

Test Results

An igniter 26 was constructed with central electrode 30 made of nickel alloy, dielectric 38 made of Corning Glass No. 9013, and conductive body 48 made of 304L stainless steel. Hot wire 56 was made of Nichrome with a diameter of 2.25 mils and a resistance of 173.0 ohms/foot. Hot wire 56 was welded to central electrode 30 and conductive body 48. Ignition mixture 58 was made of zirconium potassium perchlorate (ZPP) comprising zirconium 52%, potassium perchlorate 42%, graphite 1%, and Viton® 5%. Cup 60 was made of 304L stainless steel with a cruciform on its top surface for uniform rupture and ignition. Cup 60 was TIG welded to conductive body 48 to provide a hermitic seal and structural integrity.

The igniter 26 survived a ballistic test at 6900 bars (100 ksi). The amounts of electromagnetic field intensity required to exceed the no-fire energy threshold of a prior art igniter and igniter 26 were compared. The tests were conducted at worst case conditions wherein the EMF transmitter was tuned to the natural frequency with a metal object touching the central electrode. The prior art igniter required about 1 $mW/cm^2$ to exceed the no-fire energy threshold while igniter 26 required about 24.4 $mW/cm^2$. Igniter 26 displayed a very notable twenty-four fold improvement in the EMF threshold. Igniter 26 may be adapted to function on all electrically fired ammunition to thereby render the ammunition EMF hardened. The function time of igniter 26 was about 2 ms faster than the prior art igniter. Igniter 26 is hermetically sealed, but the prior art igniter relies on the cartridge environment for sealing.

While the invention has been described with reference to certain embodiments, numerous changes, alterations and modifications to the described embodiments are possible without departing from the spirit and scope of the invention as defined in the appended claims, and equivalents thereof.

What is claimed is:

1. An electric and magnetic field hardened igniter for electrically fired ammunition, comprising:

a central electrode having an input end, an output end, and an outer surface;

a dielectric that surrounds the central electrode, the dielectric having an outer surface and an inner surface, the inner surface being contiguous to the outer surface of the central electrode, the outer surface of the central electrode and the inner surface of the dielectric being fixed to each other by at least one mechanical lock wherein the at least one mechanical lock that fixes the outer surface of the central electrode and the inner surface of the dielectric comprises protrusions on the inner surface of the dielectric and corresponding mating circumferential channels in the outer surface of the central electrode;

a conductive body that surrounds the dielectric, the conductive body having an inner surface that is contiguous to the outer surface of the dielectric, the inner surface of the conductive body and the outer surface of the dielectric being fixed to each other by at least one mechanical lock wherein the at least one mechanical lock that fixes the outer surface of the dielectric and the inner surface of the conductive body comprises a stepped down portion on the inner surface of the conductive body and a corresponding mating stepped up portion on the outer surface of the dielectric wherein said mechanical lock is proximal to the hot wire;

at least one hot wire fixed at one end to the output end of the central electrode and at another end to the conductive body;

an ignition mixture in contact with a majority of surface area of the at least one hot wire wherein said ignition mixture comprises zirconium, potassium perchlorate, graphite, and Viton; and a cup that surrounds and contains the ignition mixture, the cup having an inner surface that is contiguous to the ignition mix, the cup being fixed to the conductive body.

2. The igniter of claim 1, wherein the central electrode has a generally cylindrical shape, the dielectric has a generally hollow cylindrical shape, and the conductive body has a generally hollow cylindrical shape.

3. The igniter of claim 1, wherein the at least one hot wire is parallel to a plane that contains the output end of the central electrode.

4. The igniter of claim 3, wherein the dielectric includes an output end and the conductive body includes an output end, and the hot wire is in contact with the output end of the central electrode, the output end of the dielectric and the output end of the conductive body.

5. The igniter of claim 4, wherein the hot wire is welded to the output end of the central electrode and the output end of the conductive body.

6. The igniter of claim 3, wherein the cup includes a bottom and a side, the bottom being parallel to the plane that contains the output end of the central electrode.

7. The igniter of claim 6, wherein the cup is fixed to the conductive body by welding the side of the cup to the conductive body.

8. A primer head assembly, comprising:

a primer housing; and the igniter of claim 1 disposed in the primer housing.

9. An electric primer, comprising:

the primer head assembly of claim 8; and a primer body assembly fixed to the primer head assembly.

10. An electrically fired munition, comprising:

a case with a base;

the electric primer of claim 9 disposed in the base; and propellant disposed in the case.

11. An electrically fired munition comprising the igniter of claim 1.

12. An electric and magnetic field hardened igniter for electrically fired ammunition, comprising:

a generally cylindrical central electrode having an input end, an output end, and an outer surface;

a generally cylindrical, hollow dielectric that surrounds the central electrode, the dielectric having an outer surface and an inner surface, the inner surface being contiguous to the outer surface of the central electrode, the outer surface of the central electrode and the inner surface of the dielectric being fixed to each other by at least one mechanical lock wherein the at least one mechanical lock that fixes the outer surface of the central electrode and the inner surface of the dielectric comprises protrusions on the inner surface of the dielectric and corresponding mating circumferential channels in the outer surface of the central electrode;

a generally cylindrical, hollow conductive body that surrounds the dielectric, the conductive body having an inner surface that is contiguous to the outer surface of the dielectric, the inner surface of the conductive body and the outer surface of the dielectric being fixed to each other by at least one mechanical lock wherein the at least one mechanical lock that fixes the outer surface of the dielectric and the inner surface of the conductive body comprises a stepped down portion on the inner surface of the conductive body and a corresponding mating stepped up portion on the outer surface of the dielectric wherein the at least one mechanical lock is proximal to the hot wire;

a hot wire fixed at one end to the output end of the central electrode and at another end to the conductive body;

an ignition mixture in intimate contact with the hot wire wherein said ignition mixture comprises zirconium, potassium perchlorate, graphite, and Viton; and a cup that surrounds and contains the ignition mixture, the cup having an inner surface that is contiguous to the ignition mix, the cup being fixed to the conductive body.

13. The igniter of claim 12, wherein the dielectric includes an output end and the conductive body includes an output end, and the hot wire is in contact with the output end of the central electrode, the output end of the dielectric and the output end of the conductive body.

14. The igniter of claim 13, wherein the hot wire is welded to the output end of the central electrode and the output end of the conductive body.

15. The igniter of claim 12, wherein the cup includes a bottom and a side, the bottom being parallel to the plane that contains the output end of the central electrode.

16. The igniter of claim 15, wherein the cup is fixed to the conductive body by welding the side of the cup to the conductive body.

17. The igniter of claim 12 wherein the at least one mechanical lock that fixes the outer surface of the central electrode and the inner surface of the dielectric comprises protrusions on the inner surface of the dielectric and corresponding mating circumferential channels in the outer surface of the central electrode.

18. The igniter of claim 12, wherein the at least one mechanical lock that fixes the outer surface of the dielectric and the inner surface of the conductive body comprises a stepped down portion on the inner surface of the conductive body and a corresponding mating stepped up portion on the outer surface of the dielectric.

* * * * *